US007318253B2

(12) United States Patent
Elsasser et al.

(10) Patent No.: US 7,318,253 B2
(45) Date of Patent: Jan. 15, 2008

(54) CARD TOP ASSEMBLY FOR A CARDING MACHINE

(75) Inventors: Nicole Elsasser, Aachen (DE); Thomas Landmesser, Erkelenz (DE)

(73) Assignee: Truetzschler GmbH & Co. KG, Monchengladbach (DE)

( * ) Notice: Subject to any disclaimer, the term of this patent is extended or adjusted under 35 U.S.C. 154(b) by 436 days.

(21) Appl. No.: 10/925,012

(22) Filed: Aug. 25, 2004

(65) Prior Publication Data

US 2005/0044667 A1 Mar. 3, 2005

(30) Foreign Application Priority Data

Aug. 25, 2003 (DE) ..... 103 38 947
Jul. 10, 2004 (DE) ..... 10 2004 033 509

(51) Int. Cl.
*D01G 15/84* (2006.01)

(52) U.S. Cl. ..... 19/114

(58) Field of Classification Search ..... 19/102, 19/113, 114

See application file for complete search history.

(56) References Cited

U.S. PATENT DOCUMENTS 3,151,362 A 10/1964 Freitag
6,070,302 A 6/2000 Graf
6,704,970 B2 * 3/2004 Ebenhoh et al. ..... 19/114
2001/0018781 A1 9/2001 Wurst
2002/0069486 A1 * 6/2002 Wust et al. ..... 19/102
2003/0070261 A1 * 4/2003 Pferdmenges ..... 19/113
2003/0182765 A1 * 10/2003 Pferdmenges ..... 19/114
2004/0000034 A1 * 1/2004 Schurenkramer et al. ..... 19/102
2007/0006424 A1 * 1/2007 Landmesser ..... 19/145.7

FOREIGN PATENT DOCUMENTS

DE 1 685 600 10/1971
DE 100 07 268 C2 9/2001
DE 102 03 853 A1 8/2003
GB 1 309 229 A 3/1973
GB 1 582 070 A 12/1980
GB 2 233 008 A 1/1991
GB 2 386 911 A 10/2003

* cited by examiner

*Primary Examiner*—Shaun R. Hurley
(74) *Attorney, Agent, or Firm*—Venable LLP; Robert Kinberg; Steven J. Schwarz

(57) ABSTRACT

In an arrangement at a carding machine for cotton, synthetic fibres and the like, at least one card top bar has a carrier and card top clothing. The card top clothing is fastened to the card top bar carrier and is positioned opposite to the clothing of a roller, e.g. the cylinder, and at least the regions of the clothing that face the card top bar carrier are made of a ferrous product, especially steel. In order to enable there to be obtained in simple manner a dimensionally stable clothed card top bar and simpler and more rapid reclothing (clothing replacement), at least one magnetic element is present between the card top bar carrier and the regions of the clothing member that face the card top bar carrier.

28 Claims, 9 Drawing Sheets

CARD TOP ASSEMBLY FOR A CARDING MACHINE

CROSS REFERENCE TO RELATED APPLICATION

This application claims priority from German Patent Application Nos. 103 389 47.4 dated 25 Aug. 2003 and 10 2004 033 509.5 dated 10 Jul. 2004, the disclosures of which are incorporated herein by reference.

BACKGROUND OF THE INVENTION

The invention relates to a card top assembly for a carding machine.

In a known kind of carding machine cotton, synthetic fibres and the like, there is at least one card top bar having card top clothing, the card top clothing being fastened to the card top bar and positioned opposite to the clothing of a roller, e.g. the cylinder, and at least the regions of the clothing that face the card top bar being made of a ferrous product, especially steel.

In a known arrangement (U.S. Pat. No. 3,151,362), the card top bar consists of a back portion and a carrier body (carrier) having a foot face. Fastened to the foot face (portion that accommodates the clothing) is all-steel clothing or a clothing strip (flexible clothing) that extends in the longitudinal direction of the foot face. The all-steel clothing consists of a large number of saw-tooth wire portions arranged adjacent to one another. The clothing strip comprises a carrying element consisting of a plurality of textile layers, in which a large number of small wire hooks (clothing tips) are fastened. The regions of the steel clothings that are in each case remote from the tips are associated with the card top bar. The clothing strip is fastened along the longitudinal sides of the carrier body by means of two clamps (brackets, clips). With one end, the clamps encompass the longitudinally oriented edge regions of the clothing strip and with their other end engage in recesses in the carrier body. In practice, the clamps consist of a sheet metal strip, one longitudinal edge of which is cut into the textile material. On assembly, the textile material of the clothing strip is fastened to the carrier body of the card top bar in a positive fit under considerable stress. In the process, the clamps exert tensile forces in such a manner that the textile material is deformed convexly away from the foot face, so that the clothing tips facing outwards are also, undesirably, arranged on a convex-shaped envelope. When not in use, the resulting card top assembly has a precision of 0.05 mm in height and evenness. In use, the differences in height in the assembly increase to approximately 0.2 mm. Sharpening the clothing on the machine improves precision only insignificantly. After a throughput of approximately 400 t of fibre material, the card top clothing is so worn that it has to be replaced. In order to dismantle the sheet metal staples, the card top bar is clamped and the positive fit is reversed by means of a lever and pincers. The considerable forces that occur during assembly and dismantling have a deleterious effect on the dimensional stability of the card top bar.

It is an aim of the invention to provide an arrangement of the type described at the beginning that avoids or mitigates the disadvantages mentioned, makes it possible, especially in simple manner, to obtain a clothed card top bar that is dimensionally stable and enables simpler and more rapid reclothing (clothing replacement).

SUMMARY OF THE INVENTION

The invention provides a card top bar for a carding machine, comprising a card top bar carrier member; a clothing member comprising a ferrous portion; and at least one magnetic element positioned between the card top bar carrier member and said ferrous portion of said clothing member.

The solution makes it possible to obtain a simplified seating for the clothing strip (carrier layer and wires arranged in accordance with the setting configuration) on the card top bar, which additionally enables replacement to be made without causing any damage. For example, when the clothing is worn, the clothing strip to be replaced can be removed easily and the undamaged card top bar having the clothing seating according to the invention can be used for a new clothing strip.

Advantageously, a magnetic component comprising a said magnet is fastened to the card top bar carrier member. Advantageously, a magnetic component comprising a said magnetic element is fastened by means of an adhesive layer or the like. Advantageously, a magnetic component comprising a said magnetic element is fastened by a screw connection or the like. Advantageously, the or each magnetic element is a permanent magnet, for example is of a permanent magnetic material. Advantageously, the magnetic force is greater than the forces acting upon the clothing member, e.g. carding force, force of a rotating cleaning roller or the like. Advantageously, the clothing member is detachable from the magnetic component. Advantageously, the clothing member is connected to the card top bar by means of the magnetic component as fastening element.

Advantageously, the clothing is reversibly detachable from the magnetic component. Advantageously, the clothing, which is set into a backing layer, e.g. fabric or the like, consists of wires or the like that are bent approximately in a U-shape and are so inset that the web portion of the U-shaped wires or the like runs on the reverse side of the backing layer. Advantageously, a compensating layer is present between the card top bar carrier member and the clothing member, which compensating layer is able to compensate for different spacings between the carrier member and the clothing member. Advantageously, the compensating layer is able to compensate for different spacings between the reverse face of the card top clothing member and the foot face of the card top bar carrier member. A compensating layer may be able to compensate for one or more of: different spacings between the sliding surfaces of the card top heads and the foot face of the card top bar; different spacings between the sliding surfaces of the card top heads and the circle formed by the tips of the clothing; different spacings between the circle formed by the tips of the clothing and the circle formed by the tips of the clothing on the cylinder; local different spacings between the reverse face and the foot face. The upper face of the cylinder clothing may constitute a reference surface for the orientation of the card top bar carrier member and of the card top clothing member. The card top bar may form part of a revolving card top. The card top bar may be a fixed carding element.

Advantageously, flexible clothing is present. Advantageously, the flexible clothing comprises a carrier and clothing tips, wires, hooks or the like. Advantageously the carrier is strip-shaped. Advantageously, the clothing consists of saw-tooth wire strips, e.g. all-steel clothing. Advantageously, the clothing is mounted on the card top bar carrier member in the region of the foot face. Advantageously, a plastics material, an artificial resin, e.g. epoxy resin, or the like is provided as compensating substance. The card top bar carrier member may be a shape extruded from a light metal, e.g. aluminium. The extruded shape may be a hollow shape. Advantageously, two end pieces (card top heads) are associated with the carrier body. Preferably, the end pieces are pins of hardened steel or the like. Advantageously, the carrier element (textile material) and the compensating layer are arranged in a recess of the foot face (carrier body). Preferably, the recess is limited by at least two lateral webs or the like on the longitudinal sides of the carrier body.

Advantageously, the underside of the clothing strip, on which the spines of the bent wires are located, is held securely by means of a magnet fixed to the card top bar carrier member. Advantageously, the clothing strip is additionally fixed laterally to the side faces of the carrier layer, for example by webs mounted on the card top bar carrier member. Advantageously, all the clothing strips, e.g. irrespective of the setting configuration, are arranged to be held flexibly by a magnet, so providing the connection to the card top bar carrier member.

Advantageously, the connection is supported mechanically, e.g. by pieces of sheet metal fastened to the card top bar carrier member. Advantageously, there is additional securing or holding of the clothing strip in the horizontal plane e.g. by the clothing strips being held mechanically by webs. Advantageously, two webs are present on the longitudinal sides and/or two webs are present on the transverse sides. Advantageously, a clothing strip is accommodated, to which there is additionally fastened, by way of a compensating adhesive layer, a piece of sheet metal which is brought into contact with the magnet of the card top bar carrier member. Advantageously, the vertical connection is supported mechanically. Advantageously, the clothing strip is additionally provided with e.g. wire claws or the like at its outer edges where there is only carrier layer and none of the wires embedded therein.

Advantageously, the magnetic component, e.g. magnetic tape, magnetic strip, magnetic bar or the like, extends in the longitudinal direction of the card top bar. Advantageously, a plurality of magnetic elements is present in the longitudinal direction of the card top bar. Advantageously, the magnetic elements are arranged spaced from one another. Advantageously, the magnetic elements are arranged offset relative to one another. Advantageously, the direction of offsetting is the working direction. Advantageously, a base made from a magnetic material is arranged on the reverse side of the card top clothing member. Preferably, the base is a steel tape, piece of sheet metal or the like.

Preferably, the base has on its sides attachments, webs or the like that are bent at an angle. Advantageously, the card top clothing member has at least two groups of clothing, each of which is held by a magnet. Advantageously, at least two groups of clothing each have a heel zone relative to the roller clothing. Advantageously, the card top clothing member consists of a large number of all-steel clothing wires arranged axially relative to the clothed roller, e.g. cylinder. Advantageously, the card top clothing member is held on the card top bar carrier member by at least one magnetic element. Advantageously, the card top bar carrier member consists of a fibre-reinforced plastics material, for example, a glass-fibre-reinforced plastics material is used. Advantageously, a carbon-fibre-reinforced plastics material is used. Advantageously, the magnetic element is integrated in the fibre-reinforced plastics material, for example, by casting the magnetic element integrally with the plastics card top bar carrier member. The magnetic element may be cast or pressed into the plastics card top bar carrier member. Advantageously, the magnetic element is incorporated during manufacture of the plastics card top bar carrier member. Advantageously, at least one and preferably each of the edge regions bordering the longitudinal edges is provided with tips.

The invention also provides a card top bar for a carding machine, having a card top bar carrier member and a clothing member attached to the card top carrier member with an inner surface of the clothing member facing the carrier member, at least a region of the inner surface comprising a ferrous material, wherein at least one magnetic element is provided between the carrier member and the ferrous region or regions of the clothing member.

Moreover, the invention provides an arrangement at a carding machine for cotton, synthetic fibres and the like, in which there is at least one card top bar having card top clothing, the card top clothing being fastened to the card top bar and positioned opposite to the clothing of a roller, e.g. the cylinder, and at least the regions of the card top clothing that face the card top bar being made of a ferrous product, especially steel, wherein between the card top bar and the regions of the card top clothing facing the card top bar there is at least one magnetic element.

DESCRIPTION OF PREFERRED EMBODIMENTS

Figure 1:
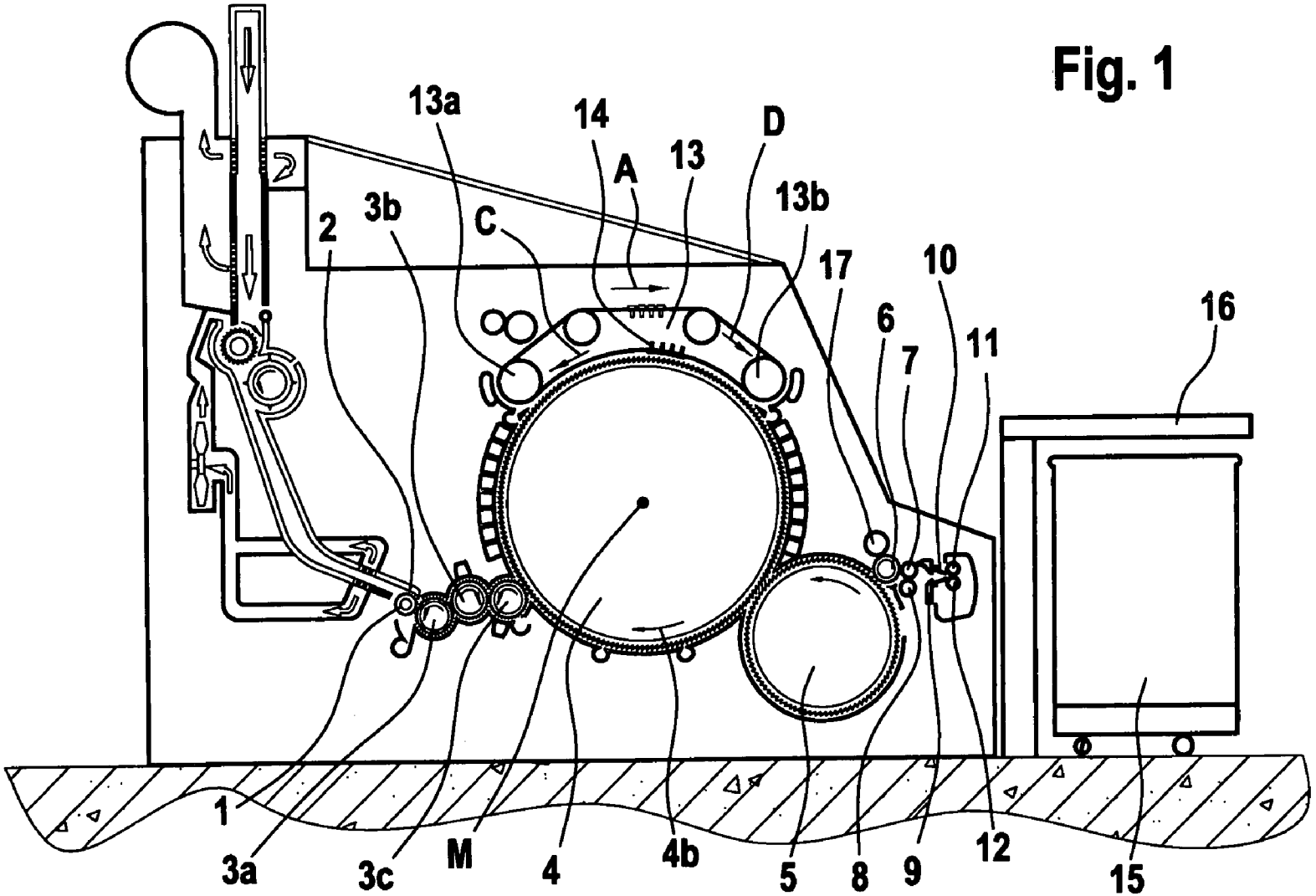
FIG. 1 is a diagrammatic side view of a carding machine comprising an arrangement according to the invention.

With reference to FIG. 1. a carding machine, for example a TC 03 carding machine made by Trützschler GmbH & Co. KG of Mönchengladbach, Germany, comprises a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15 and can coiler 16. The directions of rotation of the rollers are indicated by curved arrows. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter D denotes the direction in which the card top bars 14 are moved on the reverse side.

Figure 2:
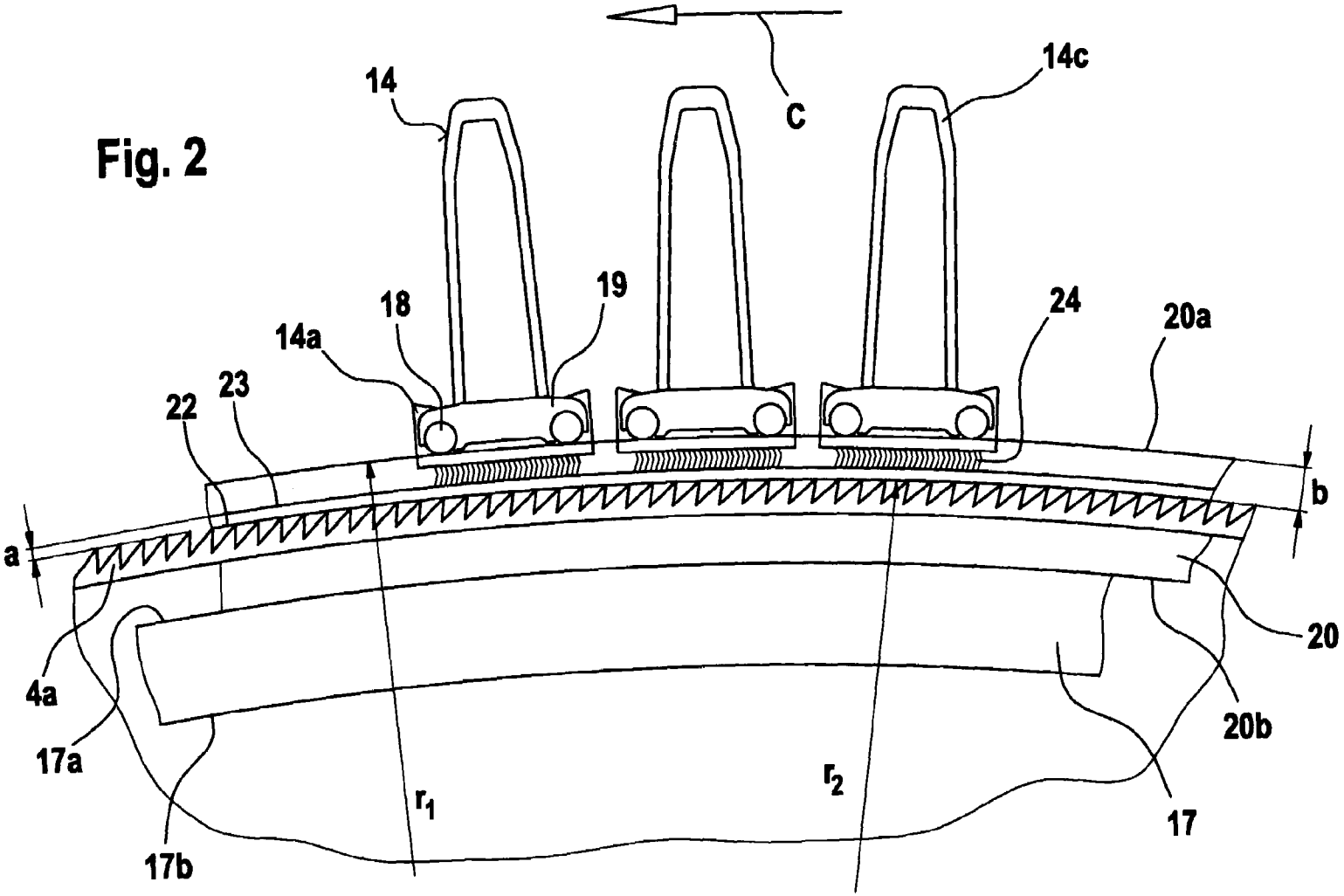
FIG. 2 shows card top bars with a cut-away view of a slideway and a flexible bend.

Referring to FIG. 2, a flexible bend 17 comprising a plurality of adjusting screws is fastened laterally by screws to each side of the machine framework. The flexible bend 17 has a convex outer face 17*a* and a lower face 17*b*. Above the flexible bend 17 there is a slideway 20, for example made of a slideable plastics material, that has a convex outer face 20*a* and a concave inner face 20*b*. The concave inner face 20*b* rests on the convex outer face 17*a*. The card top bars 14, which are extruded from aluminium, have a carrier body 14*c* and, at both their ends, have a card top foot 14*a* to which there are fastened axially two steel pins 18 which slide on the convex outer face 20*a* of the slideway 20 in the direction of arrow C. The card top clothing 24 is attached to the lower face of the card top foot 14*a*. Reference numeral 23 denotes the circle formed by the tips of the card top clothings 24.

The cylinder 4 has around its circumference a cylinder clothing 4*a*, for example saw-tooth clothing. Reference numeral 22 denotes the circle formed by the tips of the cylinder clothing 4*a*. The distance between the tip circle 23 and the tip circle 22 is denoted by reference letter a and is, for example, 2/1000". The distance between the convex outer face 20*a* and the tip circle 22 is denoted by reference letter b. The variable radius of the convex outer face 20*a* is denoted by reference letter $r_1$ and the constant radius of the tip circle 22 is denoted by reference letter $r_2$. The radius $r_2$ intersects the centre M (see FIG. 1) of the cylinder 4. Reference numeral 14*c* denotes the backs of the card top bars. Reference numeral 19 denotes a clamping element that engages the card top pins 18 and that is connected to the drive belt (not shown) for the card top bars 14.

Figure 3:
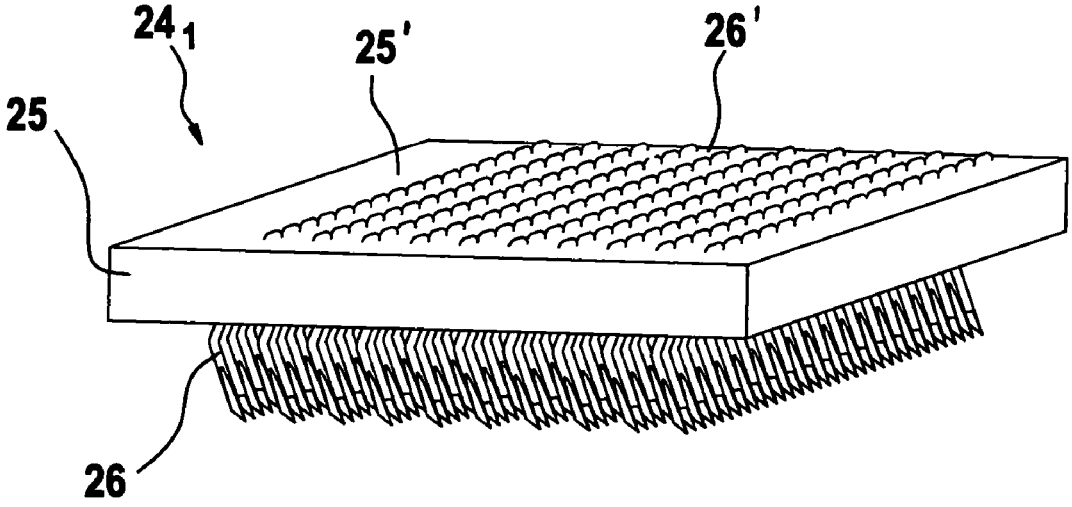
FIG. 3 is a perspective view of a clothing strip comprising a carrier layer and small wire hooks.

In the embodiment of FIG. 3, the card top clothing 24 consists of clothing tips 26 (small wire hooks) and a carrier element 25 of a textile material. The small wire hooks 26 are approximately U-shaped and are fastened in the carrier element 25 by being pushed through the surface 25'. The bent-round regions 26' of the small wire hooks 26 project above the surface 25'. The ends of the wire hooks 26, that is to say the clothing tips, are free. The wire hooks 26 are made of steel wire.

Figure 4:
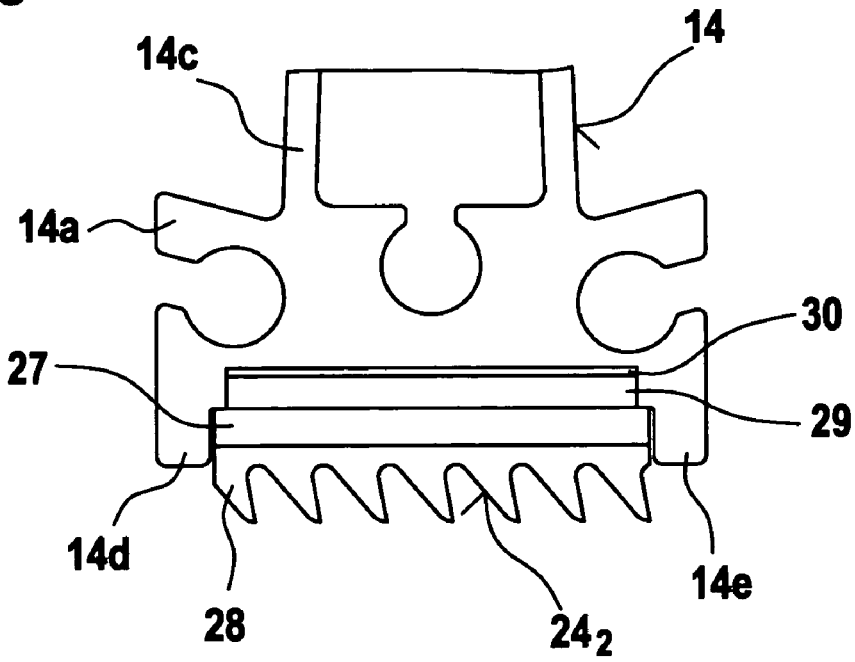
FIG. 4 is a side view of a card top bar, in detail, comprising magnetic strip and all-steel clothing.
Figure 5A:
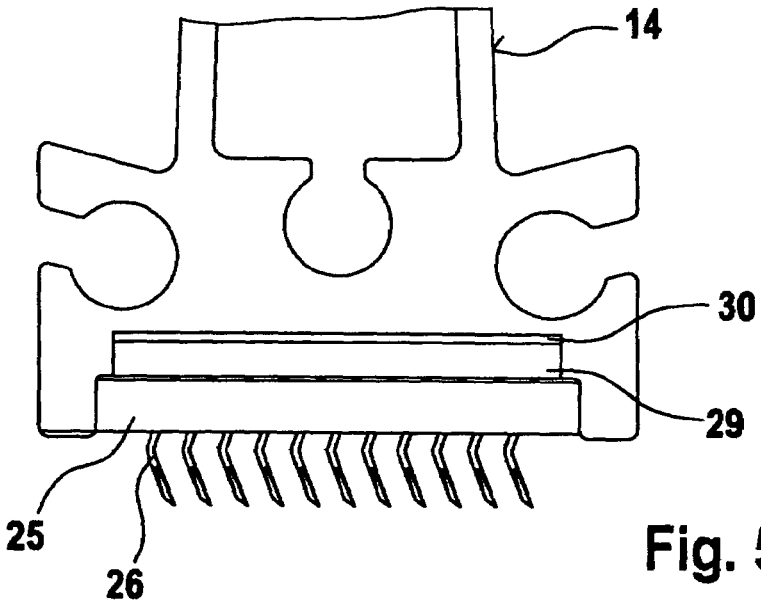
FIG. 5*a* is a side view of a card top bar, as in FIG. 4 but with the magnetic strip and clothing strip (small wire hook clothing), in the assembled state.
Figure 5B:
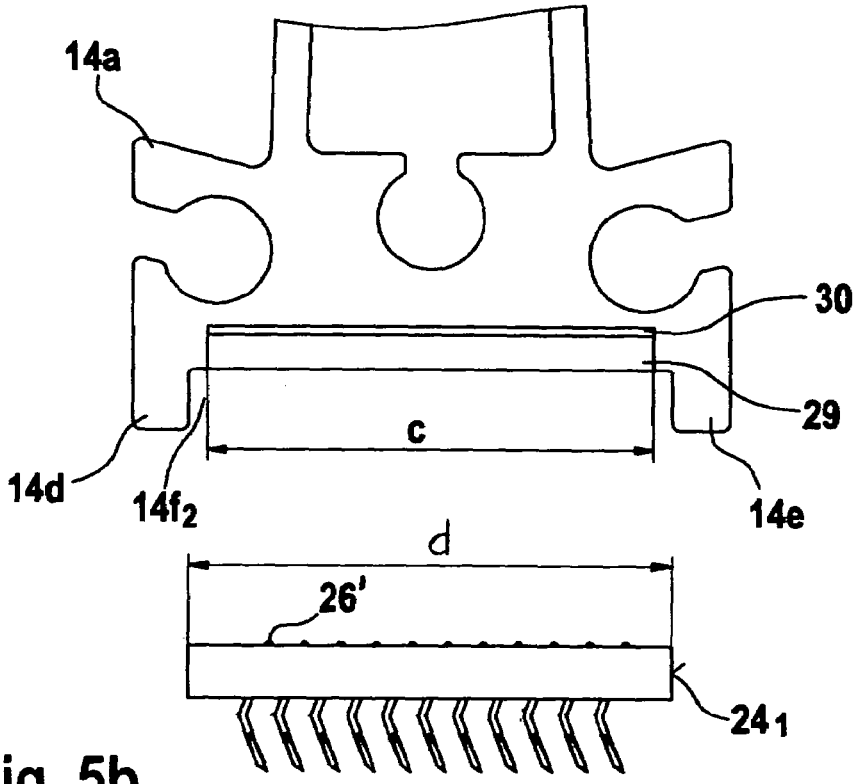
FIG. 5*b* is a side view of a card top bar, as in FIG. 5*a*, but with the clothing strip detached.
Figure 5C:
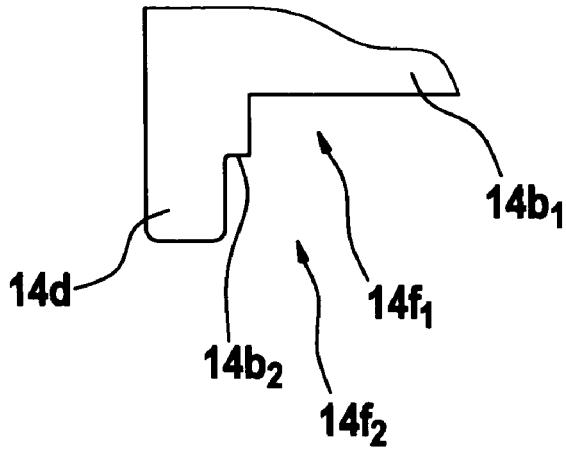
FIG. 5*c* is a cut-away view of a card top foot having two recesses.

In the embodiment of FIG. 4, two webs 14*d*, 14*e* are arranged on the card top foot 14*a* laterally in the longitudinal direction, so that in the region of the foot face 14*b* (see FIG. 5*c*) there is a two-step recess $\mathbf{14}f_1$, $\mathbf{14}f_2$ (see FIG. 5*b*, 5*c*). As a result, the card top clothing $\mathbf{24}_2$ is held, protected and embedded. In the upper recess $\mathbf{14}f_1$ there is arranged a magnetic element 29, for example a magnetic tape, magnetic strip, magnetic bar or the like, which is fastened to the foot face $\mathbf{14}b_1$ by an adhesive layer 30. In the lower recess $\mathbf{14}f_2$ there is arranged the card top clothing $\mathbf{24}_2$, which consists of a large number of saw-tooth all-steel clothing strips 28 that are held in position by a steel cassette 27. The card top clothing $\mathbf{24}_2$ is fastened to or held in position on the magnetic element 29 by its region remote from the free clothing tips (teeth).

In the embodiment shown in FIGS. 5*a* and 5*b*, the card top clothing 24, consists of small wire hooks 26 and a carrier element 25 (see FIG. 3). FIG. 5*a* shows the card top bar 14 and the card top clothing 24, in the assembled state, the card top clothing or its bent-round regions 26' being held securely by the magnet 29 so that forces acting on the card top clothing 24, by the carding machine in operation are not able to detach the card top clothing 24, from the magnet 29. According to FIG. 5*b*, the card top clothing 24, has been separated from the magnet 29 and removed from the recess $\mathbf{14}f_{21}$ for example in the event of wear, damage or the like of the clothing hooks 26. Separation from the magnet 29 can be effected by a suitable tool by means of which the holding magnetic force can be overcome. The separation can also be effected while the carding machine is running in operation during the return of the card top bars 14 on the reverse side (see arrow D in FIG. 1).

FIG. 5*c* shows a portion of the two-step recess, recess $\mathbf{14}f_1$ having a foot face $\mathbf{14}b_1$ and recess $\mathbf{14}f_2$ having a foot face $\mathbf{14}b_2$. As can be seen in FIGS. 4, 5*a* and 5*b*, 6 and 7, the width c of recess $\mathbf{14}f_1$ is smaller than the width d of recess $\mathbf{14}f_2$.

Figure 6:
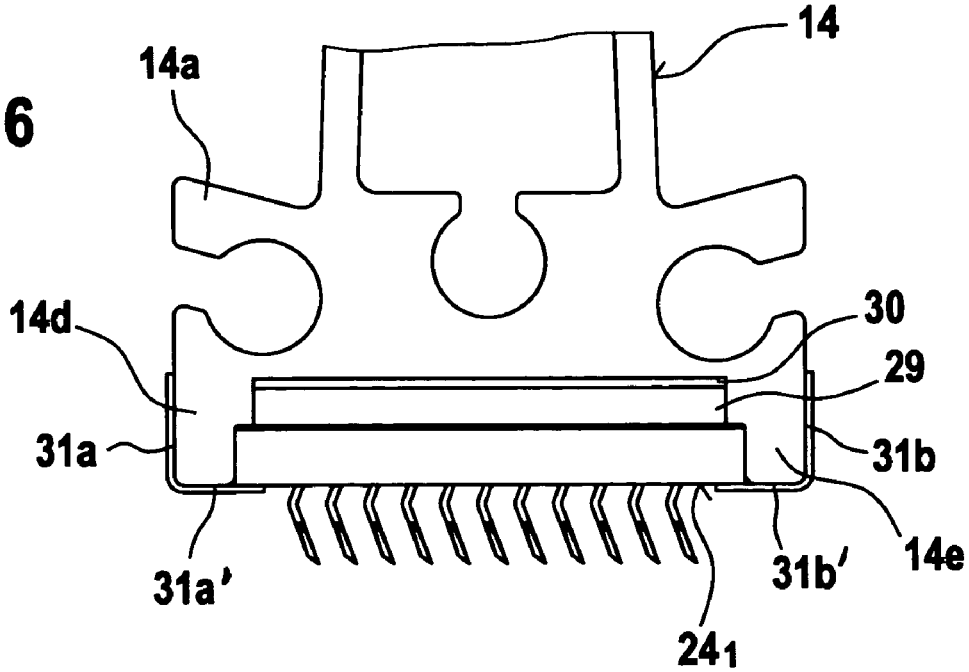
FIG. 6 is a side view of a card top bar having additional fastening elements for the card top clothing.

In the embodiment of FIG. 6, two pieces of sheet metal 31*a* and 31*b*, for example made from aluminium, are mounted on the longitudinal outer sides of the webs 14*d* and 14*e*, the free end regions of which pieces of sheet metal are bent at right angles in opposite directions (31*a*' counter-clockwise and 31*b*' clockwise) around the lower region of the webs 14*d*, 14*e*. In the position shown in FIG. 6, the regions that have been bent round 31*a*', 31*b*' provide additional holding of the carrier element 25 of the card top clothing $\mathbf{24}_1$. Before detachment of the card top clothing $\mathbf{24}_1$ from the magnet 29, the end regions are bent open through 90° (31*a*' clockwise and 31*b*' counter-clockwise). The sheet metal pieces 31*a*, 31*b* can also be formed resiliently in the form of clips.

Figure 7:
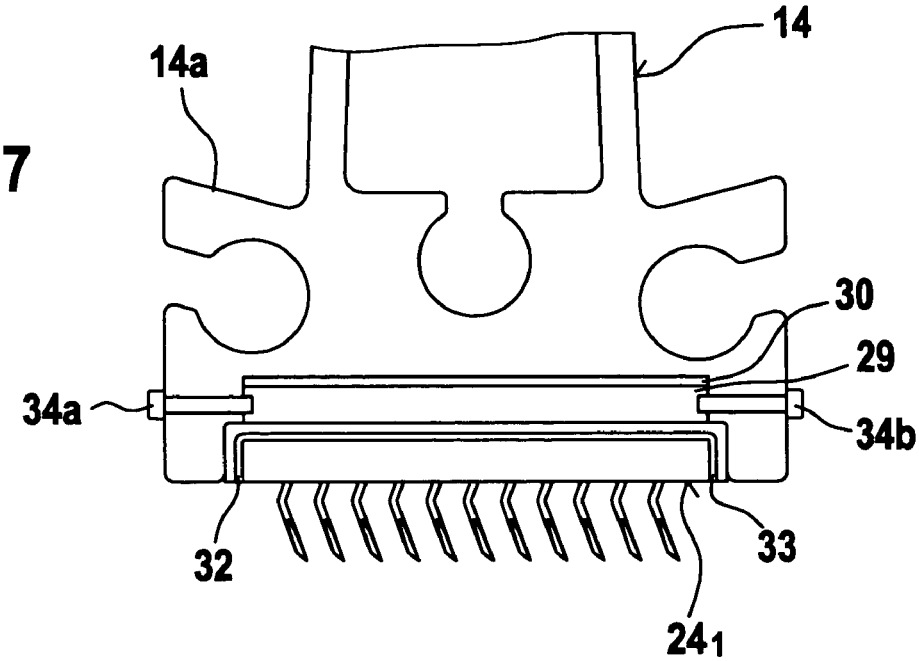
FIG. 7 is a side view of a card top bar having an additional sheet metal base, for example a steel strip and a compensating layer on the reverse side of the card top clothing.

FIG. 7 shows an embodiment of a simplified seating for clothing (magnet 29) that additionally comprises a compensating layer 32, by means of which it is possible to obtain greater card top precision and a larger fastening surface area. The compensating layer 32 is advantageously an adhesive layer, to which a piece of sheet metal 33 or the like, for example a piece of sheet steel, is fastened, which is in contact with the magnet 29. The magnet 29 is fastened to the card top foot 14*a* by lateral screws 34*a*, 34*b*.

Figure 8:
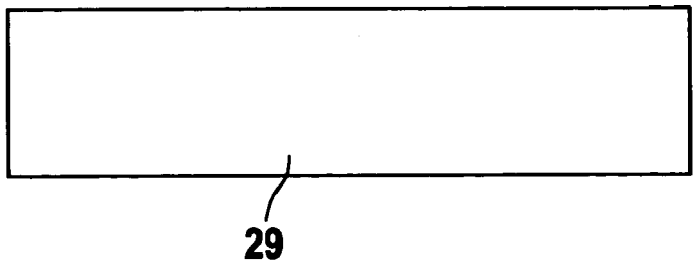
FIG. 8 is a plan view of an integral magnetic strip.
Figure 9:
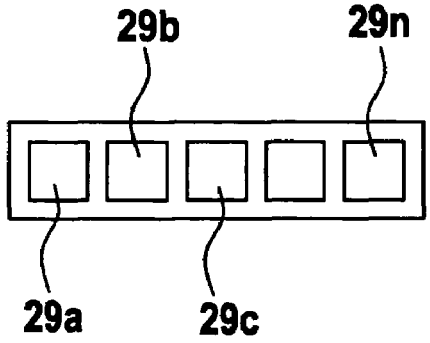
FIG. 9 is a plan view of a magnetic element consisting of a plurality of individual magnets.

FIG. 8 shows an elongate strip-shaped magnet 29. According to FIG. 9, the magnetic element consists of a plurality or large number of magnets 29*a* to 29*n*.

Figure 10:
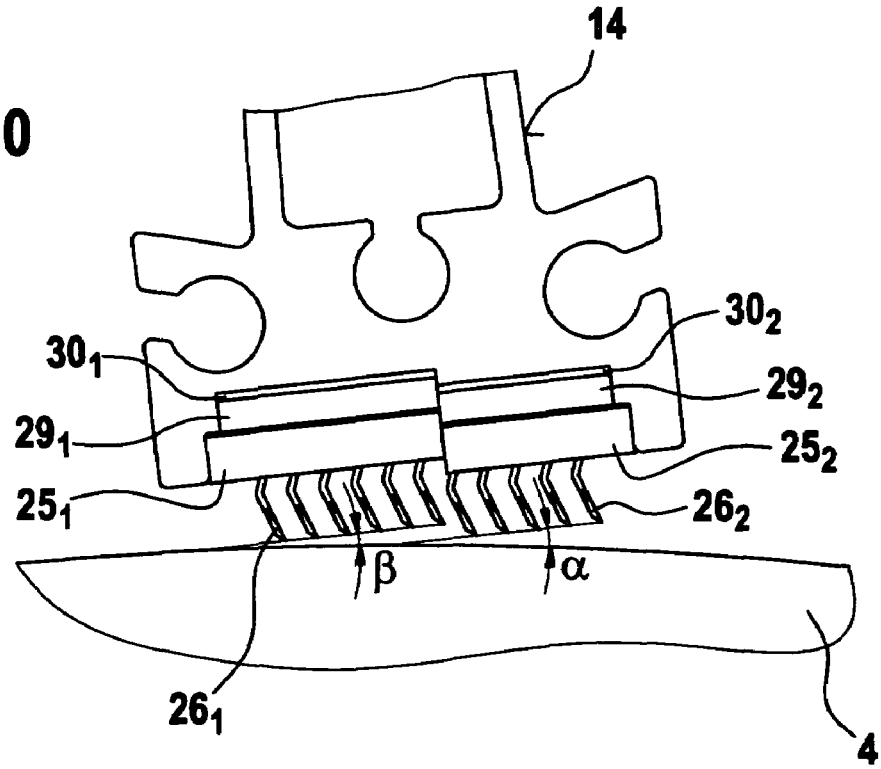
FIG. 10 is a side view of a card top bar having two groups of clothing, each having a heel zone and having two magnets.

In the embodiment of FIG. 10, the tips of the clothing 26 are divided into two groups $\mathbf{26}_1$, $\mathbf{26}_2$ with two carrier elements 25, and 252, respectively. The two card top clothing strips so formed are each fastened to an associated magnetic element 291 and 292, respectively, for example, by respective adhesive strips $\mathbf{30}_1$ and $\mathbf{30}_2$. The tips of the groups 261, 262 are arranged at a tangent to the clothing 4*a* of the cylinder 4 at angles α and β, respectively. In that manner each group has a heel zone (narrowest point between the card top clothing and the cylinder clothing). The card top clothing may have a ground heel portion known per se (not shown) at the narrowest point. The heel zone and ground heel portion may similarly be present in the other embodiments of the invention.

Figure 11:
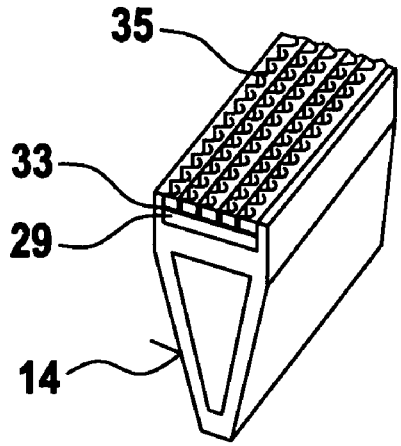
FIG. 11 is a perspective view of a card top bar comprising a large number of all-steel clothing wires arranged parallel to the axis of the clothed roller.

In the embodiment of FIG. 11, a large number of all-steel clothing wires 35 are arranged parallel to the axial direction, for example, of the cylinder 4, and are held in position by the magnet 29.

Figure 12A:
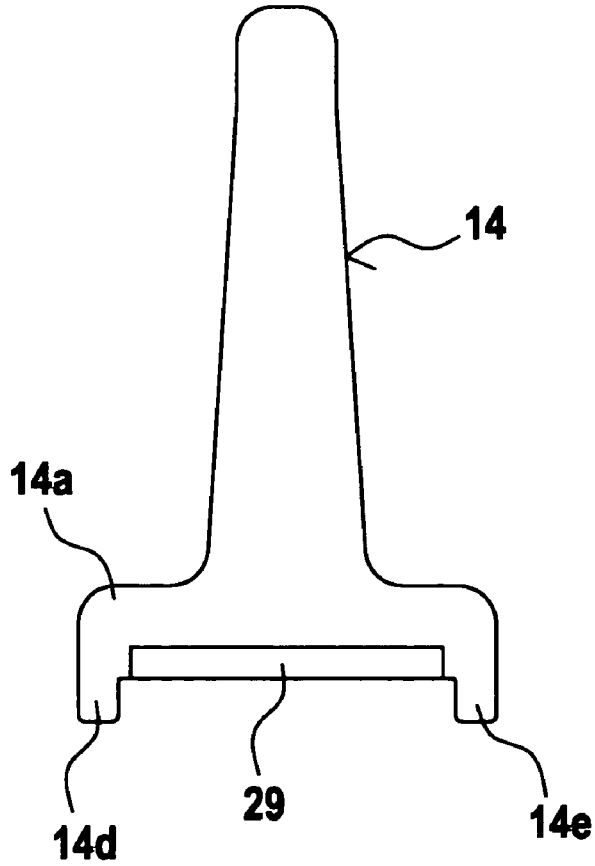
FIG. 12*a* is a side view of a card top bar made from fibre-reinforced plastics having an integrated magnetic element.
Figure 12B:
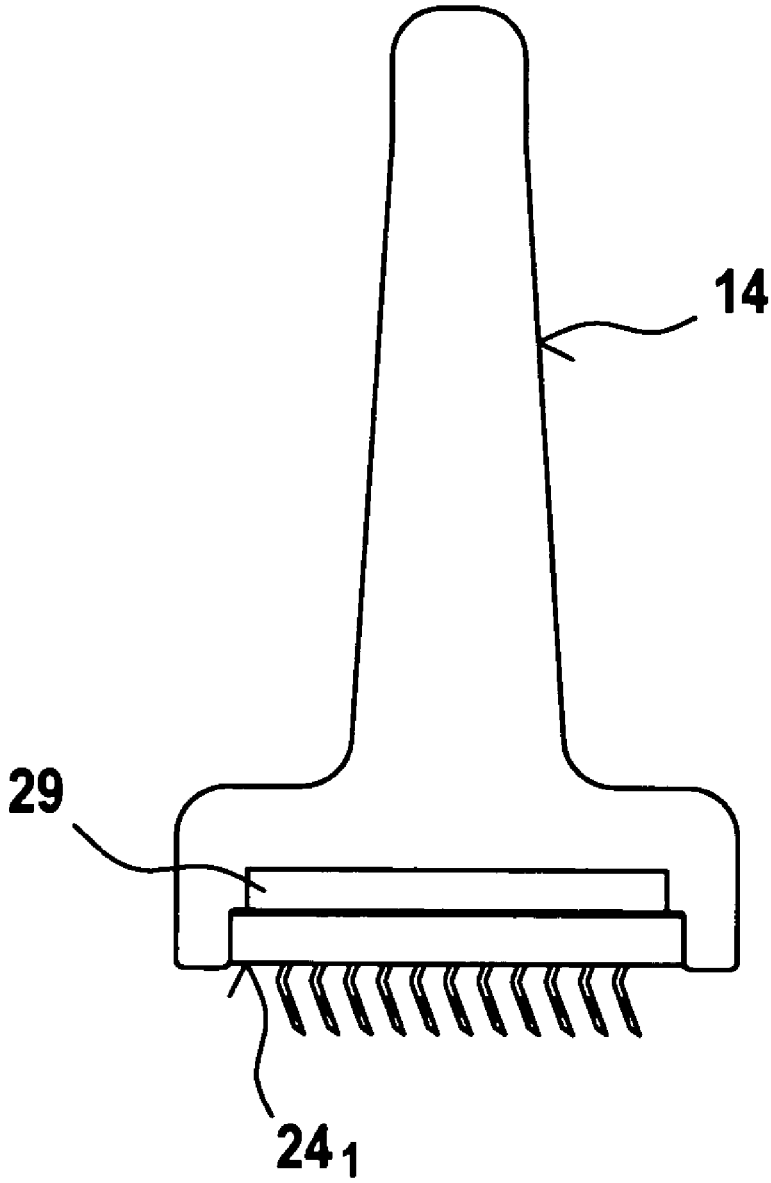
FIG. 12*b* shows a portion of the card top bar according to FIG. 12*a* with card top clothing fastened to the magnet.

In the embodiment of FIGS. 12*a* and 12*b* a card top bar 14 is made from a fibre-reinforced plastics material, for example carbon-fibre-reinforced plastics. In the recess $\mathbf{14}f_1$ (see FIG. 5*c*) there is a magnetic tape 29 which is incorporated at the time of manufacture of the card top bar 14 and is thus an integral component of the card top bar 14. The card top bar 14 can be manufactured, for example, by pressing, drawing, injection-moulding or the like. Provided a mould (matrix) is used, the magnetic strip 29 can be placed into the mould and cast or pressed at the same time. According to FIG. 12*b*, the card top clothing $\mathbf{24}_1$ is arranged in the other recess $\mathbf{14}f_2$ (see FIG. 5*c*) and is held in position and fixed by the magnetic tape 29.

The invention provides simplified accommodation of clothing on the card top bar 14, which additionally enables damage-free replacement of the strip. The invention enables simplified seating of the clothing strip (carrier layer and wires arranged according to the setting configuration) on the card top bar 14, which also allows damage-free replacement. For example, in the event of the clothing being worn, the clothing strip to be replaced can be removed easily and the undamaged card top bar 14 with the clothing seating can be used for a new clothing strip. The underside of the clothing strip, on which the spines of the bent wires are located, is held in position by means of a magnet 29 fixed to the card top bar 14, and thus the clothing strip is fixed to the card top bar 14 (FIG. 5*a*, 5*b*). The clothing strip can additionally be fixed laterally to the side faces of the carrier layer, for example by webs mounted on the card top bar 14, so providing additional securing/holding of the clothing strip in the horizontal plane of movement. All the clothing strips (e.g. irrespective of the setting configuration) are arranged to be held flexibly by a magnet, so providing the connection to the card top bar. If required, the connection is supported mechanically, e.g. by pieces of sheet metal fastened to the card top bar (FIG. 6). Advantageously additional securing/holding of the clothing strip in the horizontal plane is made possible, for example by the clothing strips being held mechanically by way of webs (e.g. two on the longitudinal sides and optionally two on the tranverse sides). Advantageously, in addition to the use of the clothing strips known in the art, it is also possible to use a modified clothing strip to which there is additionally fastened, by way of a compensating adhesive layer, a piece of sheet metal which is brought into contact with the magnet of the card top bar. Advantages of that compensating and fastening layer and of the additional sheet metal piece are that card tops can be manufactured with greater precision and the surface area of the magnetic contact is increased. In that embodiment it is also possible optionally for the vertical connection to be supported mechanically (according to FIG. 6). If required, the clothing strip is preferably additionally provided with e.g. wire claws at its outer edges where there is only carrier layer and none of the wires embedded therein, so increasing the securing of the clothing strip.

Although the foregoing invention has been described in detail by way of illustration and example for purposes of understanding, it will be obvious that changes and modifications may be practised within the scope of the appended claims.

What is claimed is:

1. A card top bar for a carding machine, comprising a card top bar carrier member;

a clothing member comprising a ferrous portion; and at least one magnetic element positioned between the card top bar carrier member and said ferrous portion of said clothing member.

2. A card top bar according to claim 1, in which a magnetic component comprising a said magnetic element is fastened to the card top bar carrier member.

3. A card top bar according to claim 1, in which the or each magnetic element is made of a permanent magnetic material.

4. A card to bar according to claim 1, in which the clothing member is detachable from the magnetic component.

5. A card top bar according to claim 1, in which the clothing member comprises a backing layer, and clothing elements set into the backing layer, the clothing elements comprising substantially U-shaped wires that are so inset that a web portion of the U-shaped wires or the like runs on the reverse side of the backing layer.

6. A card top bar according to claim 1, in which the clothing member comprises a flexible clothing.

7. A card top bar according claim 6, in which the clothing consists of saw-tooth wire strips.

8. A card top bar according to claim 6, in which the clothing is all-steel clothing.

9. A card top bar according to claim 6, in which the clothing is mounted on the card top bar carrier member in the region of a foot face thereof.

10. A card top bar according to claim 1, further comprising a compensating layer between the card top bar carrier member and the clothing member.

11. A card top bar according to claim 10, in which a carrier element for the clothing and the compensating layer are arranged in a recess of a foot face of the card top bar carrier member.

12. A card top bar according to claim 11, in which the recess is limited by at least two lateral webs or the like on the longitudinal sides of the carrier body.

13. A card top bar according to claim 1, in which one or more secondary fixing devices are provided for fastening the clothing member to the card top bar carrier member.

14. A card top bar according to claim 1, in which two webs are present on the longitudinal sides and/or two webs are present on the transverse sides of the card top bar for securing the clothing member against horizontal displacement.

15. A card top bar according to claim 1, in which the clothing member comprises a clothing strip, to which there is additionally fastened, by way of a compensating adhesive layer, a piece of sheet metal, the card top bar carrier member comprising a magnet with which the sheet metal can be brought into contact.

16. A card top bar according to claim 1, in which a magnetic component comprising the magnetic element is an elongate component that extends in the longitudinal direction of the card top bar.

17. A card top bar according to claim 1, in which a plurality of magnetic elements is present in the longitudinal direction of the card top bar.

18. A card top bar according to claim 17, in which the magnetic elements are arranged spaced from one another and/or offset relative to one another.

19. A card top bar according to claim 1, in which a base made from a magnetic material is arranged on the reverse side of the card top clothing member.

20. A card top bar according to claim 1, which has at least two card top clothing members, each of which is held by a magnet and provides a respective group of clothing tips.

21. A card top bar according to claim 20, comprising at least two groups of clothing tips, each group being arranged to have a heel zone relative to an opposed roller clothing.

22. A card top bar according to claim 1, in which the card top clothing member comprises a large number of all-steel clothing wires arranged axially relative to a clothed roller, e.g. cylinder, with which the card top bar co-operates in use.

23. A card top bar according to claim 1, in which the card top bar carrier member consists of a fibre-reinforced plastics material.

24. A card top bar according to claim 1, in which at least one magnetic element is integrated in the fibre-reinforced plastics material.

25. A card top bar according to claim 24, in which the card top bar carrier member is a shape extruded from a light metal.

26. A card top bar according to claim 1, in which the card top bar is for forming part of a revolving card top.

27. A card top bar according to claim 1, in which the card top bar is a fixed carding element.

28. A card top bar for a carding machine, having a card top bar carrier member and a clothing member attached to the card top carrier member, the clothing member having an outer, clothed surface and an inner surface, the inner surface facing the carrier member and at least a region of the inner surface comprising a ferrous material, wherein at least one magnetic element is provided between the carrier member and the ferrous region or regions of the clothing member.

* * * * *